US010968618B1

(12) United States Patent
Sherwood

(10) Patent No.: US 10,968,618 B1
(45) **Date of Patent: *Apr. 6, 2021**

(54) SUMP SYSTEM

(71) Applicant: Robert Sherwood, Almont, MI (US)

(72) Inventor: Robert Sherwood, Almont, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/816,924

(22) Filed: Mar. 12, 2020

Related U.S. Application Data

(63) Continuation-in-part of application No. 16/723,225, filed on Dec. 20, 2019, now Pat. No. 10,669,708.

(51) Int. Cl.

| | |
|---|---|
| ***E03F 1/00*** | (2006.01) |
| ***E03F 5/22*** | (2006.01) |
| ***E03F 5/14*** | (2006.01) |
| ***E03F 5/10*** | (2006.01) |
| *E03F 3/02* | (2006.01) |

(52) U.S. Cl.
CPC ..... *E03F 5/22* (2013.01); *E03F 1/002* (2013.01); *E03F 5/101* (2013.01); *E03F 5/102* (2013.01); *E03F 5/14* (2013.01); *E03F 3/02* (2013.01)

(58) Field of Classification Search
CPC ..... E03F 1/00; E03F 1/002; E03F 5/04; E03F 5/0401; E03F 5/10; E03F 5/101; E03F 5/22; E03F 7/00; E02B 11/00
USPC ..... 210/170.01, 170.03, 747.1, 747.2; 404/2, 404/4; 405/36, 42
See application file for complete search history.

(56) References Cited

U.S. PATENT DOCUMENTS

| | | | | |
|---|---|---|---|---|
| 1,327,211 A * | 1/1920 | Otterson | E03F 5/0402 | 210/170.03 |
| 1,405,725 A * | 2/1922 | Snively | E02B 11/00 | 405/36 |
| 3,862,039 A * | 1/1975 | Summers | B01D 17/0208 | 210/252 |
| 4,261,823 A | 4/1981 | Gallagher et al. | | |
| 4,824,287 A * | 4/1989 | Tracy | E03F 1/002 | 405/36 |
| 4,892,440 A * | 1/1990 | Regan | E03F 7/04 | 405/36 |
| 4,927,292 A | 5/1990 | Justice | | |
| 5,350,251 A * | 9/1994 | Daniel | A01G 25/06 | 405/36 |

(Continued)

FOREIGN PATENT DOCUMENTS

| | | |
|---|---|---|
| DE | 19726224 | * 12/1998 |
| EP | 1997971 | * 12/2008 |

*Primary Examiner* — Christopher Upton
(74) *Attorney, Agent, or Firm* — Brooks Kushman P.C.

(57) ABSTRACT

A catch basin that configured to receive runoff water includes a first tube, a second tube, and a perforated cap. The first tube extends downward from an upper end to a lower end of the catch basin. The first tube has a first cross-sectional area that is defined along a first plane that extends horizontally though the first tube. The second tube extends horizontally outward from the lower end of the first tube at position that is below the upper end. The second tube is in fluid communication with the first tube and has a second cross-sectional area that is defined along a second plane that extends horizontally though the second tube, wherein the second cross-sectional area is greater than the first cross-sectional area. The perforated cap is secured to a horizontal end of the second tube.

12 Claims, 3 Drawing Sheets

(56) References Cited

U.S. PATENT DOCUMENTS

| | | | | |
|---|---|---|---|---|
| 8,561,633 | B2 * | 10/2013 | Early | E03B 3/03 137/363 |
| 10,669,708 | B1 * | 6/2020 | Sherwood | E03F 5/101 |
| 2003/0021630 | A1 * | 1/2003 | Norman | E03F 1/002 404/4 |
| 2006/0278289 | A1 * | 12/2006 | Robinson | E03F 1/00 138/40 |
| 2012/0160352 | A1 * | 6/2012 | Humble | E03F 5/22 137/565.17 |
| 2014/0166129 | A1 | 6/2014 | Secrest et al. | |
| 2014/0353225 | A1 * | 12/2014 | Harvey | C02F 1/286 210/170.03 |
| 2019/0177963 | A1 | 6/2019 | Brant | |

* cited by examiner

SUMP SYSTEM

CROSS-REFERENCE TO RELATED APPLICATIONS

This application is a continuation-in-part of U.S. patent application Ser. No. 16/723,225 filed on Dec. 20, 2019, now U.S. Pat. No. 10,669,708, issued Jun. 2, 2020, the disclosure of which is hereby incorporated in its entirety by reference herein.

TECHNICAL FIELD

The present disclosure relates to sump systems that are configured to catch and store runoff water.

BACKGROUND

Runoff water may be directed to a catch basin of a sump system. The sump system may include a pump that is configured to pump water out of the catch basin once the water level within the catch basin rises to a certain level.

SUMMARY

A sump system includes a catch basin, a first perforated cap, and a second perforated cap. The catch basin is configured to receive runoff water. The catch basin has an upper end and a bottom surface. The catch basin defines a vertical chamber and a horizontal chamber. The vertical chamber extends downward in a vertical direction from the upper end to a first portion of the bottom surface. The horizontal chamber intersects the first chamber to form an intersecting region. The horizontal chamber is defined by an upper surface and a second portion the bottom surface. The horizontal chamber extends outwardly in a horizontal direction from an outer periphery of the first chamber and has a vertical dimension that extends upward from the bottom surface to the upper surface. The upper surface is positioned below the upper end. The first and second perforated caps are secured to the catch basin and are disposed at first and second opposing ends of the horizontal chamber, respectively.

A sump system includes a catch basin and a perforated cap. The catch basin is configured to receive runoff water. The catch basin has an upper end and a bottom surface. The catch basin defines a first chamber and a second chamber. The first chamber has a first height dimension that extends vertically downward from the upper end to a first portion of the bottom surface. The first chamber has a first width dimension. The second chamber intersects the first chamber to form an intersecting region. The second chamber has a second height dimension that extends vertically upward from a second portion of the bottom surface to an upper surface. The second chamber has a second width dimension that extends horizontally outward from an outer periphery of the first chamber to a horizontal end of the second chamber. The second height dimension is less than the first height dimension. The perforated cap is secured to the catch basin and is disposed at the horizontal end of the second chamber.

A catch basin that configured to receive runoff water includes a first tube, a second tube, and a perforated cap. The first tube extends downward from an upper end to a lower end of the catch basin. The first tube has a first cross-sectional area that is defined along a first plane that extends horizontally though the first tube. The second tube extends horizontally outward from the lower end of the first tube at position that is below the upper end. The second tube is in fluid communication with the first tube and has a second cross-sectional area that is defined along a second plane that extends horizontally though the second tube, wherein the second cross-sectional area is greater than the first cross-sectional area. The perforated cap is secured to a horizontal end of the second tube.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
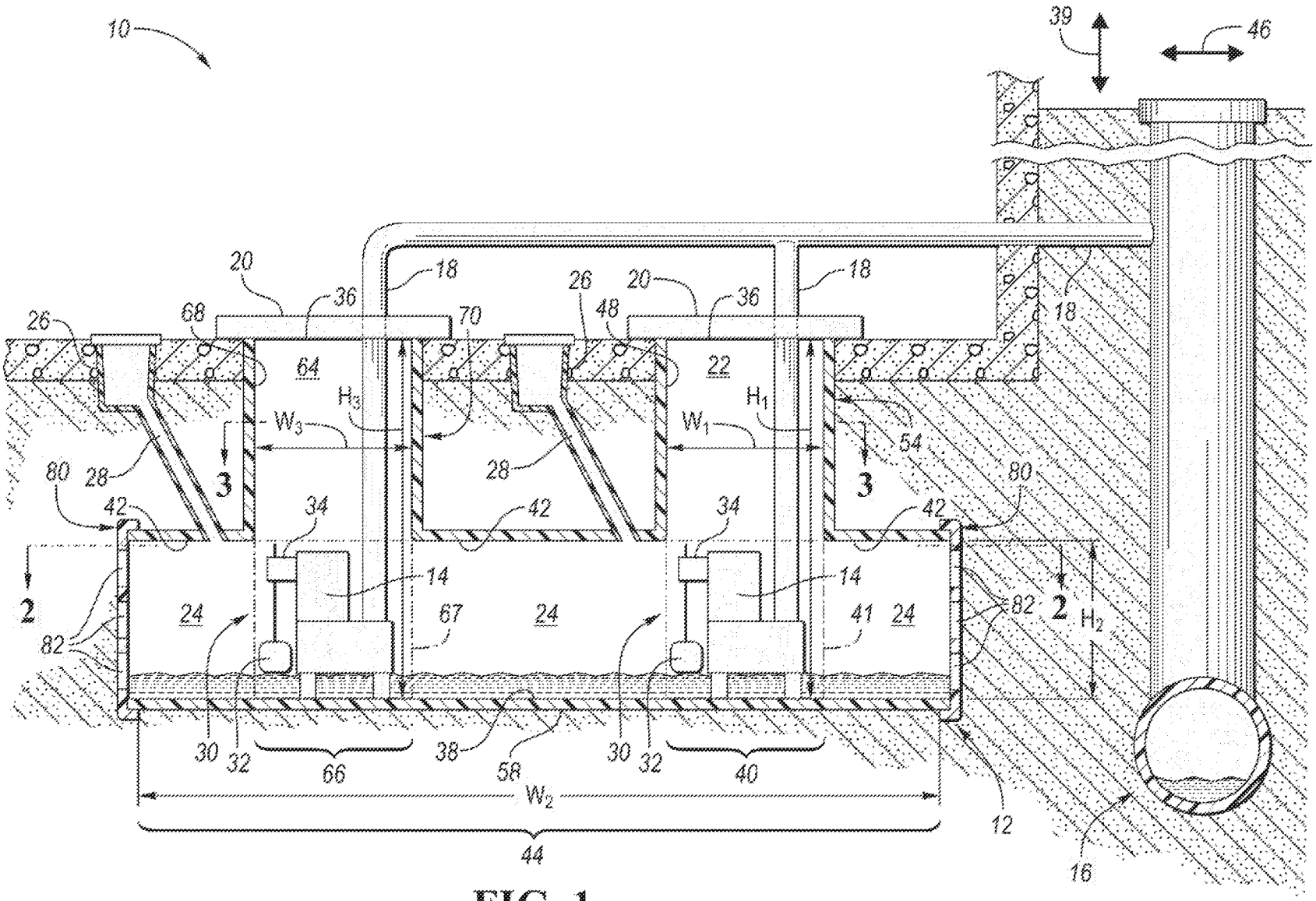
FIG. 1 is a front view of a sump system that includes a catch basin.
Figure 2:
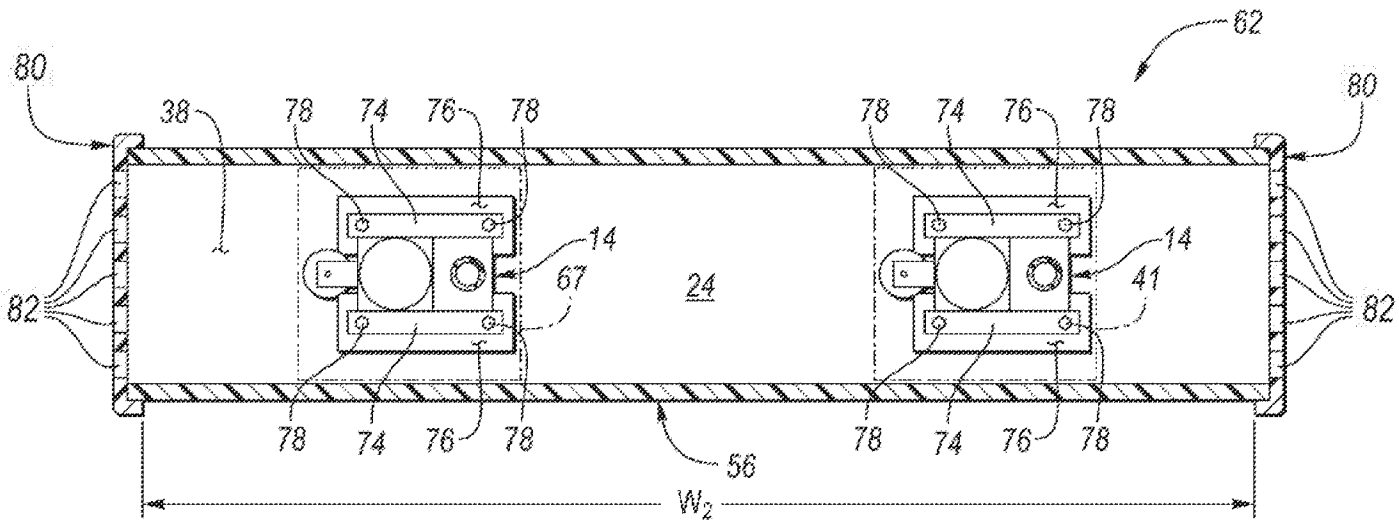
FIG. 2 is a cross-sectional view taken along line 2-2 in FIG. 1.
Figure 3:
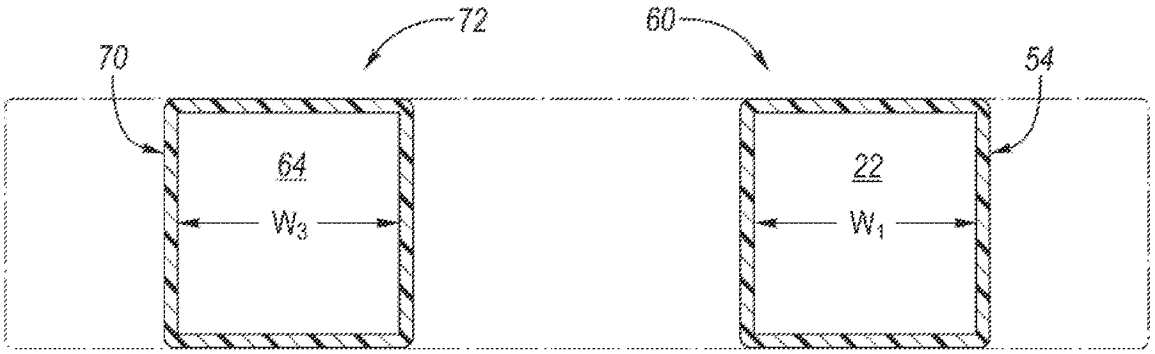
FIG. 3 is a cross-sectional view taken along line 3-3 in FIG. 1.

Referring to FIGS. 1-3, a sump system 10 is illustrated. The sump system 10 includes a catch basin 12 that defines one or more horizontal chambers and one or more vertical chambers. The catch basin 12 is configured to receive and store runoff water. The sump system 10 includes one or more sump pumps 14 that are configured to pump the runoff water out of the catch basin 12. The runoff water may be directed to a storm drain 16. The sump system 10 may be disposed within a building, as shown, or may be disposed in an outside area (i.e., not within a building). More specifically, the sump system 10 may be disposed below a lower level of a building (e.g., a basement) or at an elevation that is relatively low within an outside area so that gravity may direct runoff water to the catch basin 12.

The one or more pumps 14 may be connected to one or more outlet pipes 18 that direct the runoff water away from the catch basin 12. More specifically, the outlet pipes 18 may be in fluid communication with both the catch basin 12 and the storm drain 16 and may be configured to direct runoff water from the catch basin 12 to the storm drain 16. The outlet pipes 18 are shown to extend out of the catch basin 12 through caps or lids 20 that cover openings into the catch basin 12. It should be understood that the positioning of the outlet pipes 18 is for illustrative purposes only and that the outlet pipes 18 may be located at another position than illustrated. For example, the outlet pipes 18 may extend out of the catch basin 12 through the catch basin 12 itself. More specifically, the outlet pipes 18 may extend through one or more vertical chambers of the catch basin 12 that are located along or an upper end of the catch basin 12 or through a top portion of one or more horizontal chambers of the catch basin 12 that are located along a lower end of the catch basin 12.

The catch basin 12 may be connected to and in fluid communication with drains 26 via inlet pipes 28. The drains and inlet pipes 28 may be part of a drainage system in a building, as shown, or may be part of a drainage system for an outside area, such as a field that is being utilized for some purpose, such as a sporting event. The drains 26 and inlet pipes 28 may be configured to direct the runoff water into the catch basin 12. The inlet pipes 28 are shown to be connected to the top portion of the one or more horizontal chambers. It should be understood that the positioning of the inlet pipes 28 is for illustrative purposes only and that the inlet pipes 28 may be located at another position than illustrated. For example, the inlet pipes 28 may be connected to the one or more vertical chambers of the catch basin 12. It is also noted that for illustrative purpose some of the components (e.g., the catch basin 12, a portion of storm drain 16, and the drains 26) are shown in cross-section while other components are not.

The one or more pumps 14 may be connected to a power source, such as a battery or a power grid. Each of the one or more pumps 14 includes a switching device 30 that is configured to switch the one or more pumps 14 between an "on state" and an "off state". In the on state, the one or more pumps 14 are configured to direct runoff water out of the catch basin. In the off state, runoff water may collect in the catch basin 12 since the one or more pumps 14 are turned off. The switching device 30 may be configured to activate a respective pump 14 to direct the runoff water out of the catch basin 12 once the water within the catch basin 12 reaches a threshold level. For example, the switching device may be a float 32 that is connected to an electrical switch 34 on each pump 14. When the water level raises within the catch basin 12 to at least the threshold level, the float 32 moves upward and turns on the switch to activate a respective pump 14. When the water level drops below the threshold level, the float 32 moves downward and turns of the switch to deactivate the respective pump 12. The switching device 30 may have a hysteresis so that the threshold level that activates the respective pump 14 is slightly higher than the threshold level that deactivates the respective pump 14.

In a sump system that has a small cross-sectional area along the bottom of the catch basin of the sump system, one or pumps of such a sump system may transition between on and off states at a relatively high frequency, especially during periods where the catch basin is continuously being filled with water (e.g., during a rain storm). This may decrease the life of the pumps and increase power consumption required to operate the pumps in order to maintain the water level within the catch basin at or below the threshold level. This disclosure provides a solution to such a problem by providing a sump system that includes catch basin that has a relatively large volume along a lower portion or end of the catch basin relative to an upper portion or end of the catch basin.

The catch basin 12 has an upper end 36 and a bottom surface 38. The catch basin defines a vertical chamber 22 and a horizontal chamber 24. The vertical chamber 22 and the horizontal chamber 24 may be referred to as the first chamber and second chamber, respectively. The vertical chamber 22 extends downward in a vertical direction 39 from the upper end 36 to a first portion 40 of the bottom surface 38. The vertical chamber 22 has a first height dimension, $H_1$, that extends vertically downward from the upper end 36 to the first portion 40 of the bottom surface 38. The vertical chamber 22 also has a first width dimension, $W_1$.

The horizontal chamber 24 intersects the vertical chamber 22 to form an intersecting region 41. The horizontal chamber 24 is defined by an upper surface 42 and a second portion 44 the bottom surface 38. The horizontal chamber 24 extends outwardly in a horizontal direction 46 from an outer periphery 48 of the vertical chamber 22. The horizontal chamber 24 has a vertical dimension, which may be referred to as a second height dimension, $H_2$, that extends upward from the bottom surface 38 to the upper surface 42. The upper surface 42 is positioned below the upper end 36 of the catch basin 12 and below an upper portion of the vertical chamber 22 that is above the intersecting region 41. The horizontal chamber 24 has a second width dimension, $W_2$, that extends horizontally outward from the outer periphery 48 of the vertical chamber 22 to a first horizontal end 50 of the horizontal chamber 24. The second width dimension, $W_2$, may also extend horizontally outward from the outer periphery 48 of the vertical chamber 22 to a second end 52 of the horizontal chamber 24 in a direction that is opposite of the first end 50 of the horizontal chamber 24. The second height dimension, $H_2$, is less than the first height dimension, $H_1$, such that horizontal chamber 24 is lower than the vertical chamber 22 and the a second width dimension, $W_2$, is greater than the first width dimension, $W_1$, such that the volume of the catch basin 12 is greater along the bottom surface 38 relative to volume of the catch basin along the upper end 36.

The catch basin 12 may be comprised of a vertical tube 54, which may also be referred to as the first tube, and a horizontal tube 56, which may also be referred to as the second tube. The vertical tube 54 defines the vertical chamber 22. The vertical tube 54 extends downward from the upper end 36 of the catch basin toward a lower end 58 of the catch basin 12. The vertical tube 54 has a first cross-sectional area 60 that is defined along a first plane (i.e., the plane about which FIG. 3 is taken from FIG. 1) that extends horizontally though the vertical tube 54. The first cross-sectional area 60 includes both the outer wall of vertical tube 54 and the chamber 22 defined by vertical tube 54 (see FIG. 3). The horizontal tube 56 extends horizontally outward from the lower end 58 of the catch basin 12 at position that is below the upper end 36 of the catch basin 12. The horizontal tube 56 is in fluid communication with the vertical tube 54 and has a second cross-sectional area 62 that is defined along a second plane (i.e., the plane about which FIG. 2 is taken from FIG. 1) that extends horizontally though the horizontal tube 56. The second cross-sectional area 62 includes both the outer wall of horizontal tube 56 and the chamber 24 defined by the horizontal tube 56 (see FIG. 2). The second cross-sectional area 62 is greater than the first cross-sectional area 60.

It should be noted that the cross-sectional area of the chamber 24 defined by horizontal tube 56 in FIG. 2 is also greater than the cross-sectional area of the vertical tube 54 in FIG. 3. This is to ensure that the volume of the catch basin 12 is greater near the bottom of the catch basin 12 relative to the top of the catch basin, which increases the water storage capacity of the catch basin 12 near the bottom of the catch basin 12 relative to the top of the catch basin to reduce the frequency at which the one or more pumps 14 transition between the on state and of state. It should also be noted that if additional vertical tubes are added to the top of the catch basin 12 and/or if additional horizontal tubes are added to the bottom of the catch basin 12, the sum of the horizontal cross-sectional areas of all of the chambers defined by horizontal tubes should be greater than the sum of the horizontal cross-sectional areas of all of the chambers defined by vertical tubes.

The one or more pumps 14 are disposed with the catch basin 12. More specifically, the one or more pumps 14 are disposed along the bottom surface 38 of the catch basin 12. A first of the one or more pumps 14 may be specifically disposed within the intersecting region 41 of the horizontal chamber 24 and the vertical chamber 22.

The catch basin 12 may define a second vertical chamber 64. The second vertical chamber 64 may be referred to as the third chamber. The second vertical chamber 64 extends downward in the vertical direction 39 from the upper end 36 to a third portion 66 of the bottom surface 38. The second vertical chamber 64 has a third height dimension, $H_3$, that extends vertically downward from the upper end 36 to the third portion 66 of the bottom surface 38. The second vertical chamber 64 has a third width dimension, $W_3$.

The horizontal chamber 24 intersects the second vertical chamber 64 to form a second intersecting region 67. The upper surface 42 is positioned below the upper end 36 of the catch basin 12 and below the upper portion of the second vertical chamber 64 that is above the second intersecting region 67. A second of the one or more pumps 14 may be disposed within the second intersection region 67 of the horizontal chamber 24 and the second vertical chamber 64.

The second width dimension, $W_2$, of the horizontal chamber 24 also extends horizontally outward from the outer periphery 68 of the second vertical chamber 64 to the first horizontal end 50 of the horizontal chamber 24. The second width dimension, $W_2$, may also extend horizontally outward from the outer periphery 68 of the second vertical chamber 64 to the second horizontal end 52 of the horizontal chamber 24 in a direction that is opposite of the first horizontal end 50 of the horizontal chamber 24. The second height dimension, $H_2$, is also less than the third height dimension, $H_3$, such that horizontal chamber 24 is lower than the second vertical chamber 64 and the second width dimension, $W_2$, is greater than the sum of the first width dimension, $W_1$, and the third width dimension, $W_3$, such that the volume of the catch basin 12 is greater along the bottom surface 38 relative to volume of the catch basin along the upper end 36.

The catch basin 12 includes a second vertical tube 70, which may also be referred to as the third tube. The second vertical tube 70 defines the second vertical chamber 64. The second vertical tube 70 extends downward from the upper end 36 of the catch basin toward the lower end 58 of the catch basin 12. The second vertical tube 70 has a third cross-sectional area 72 that is defined along a third plane (i.e., the plane about which FIG. 3 is taken from FIG. 1) that extends horizontally though the second vertical tube 70. The third cross-sectional area 70 includes both the outer wall of second vertical tube 70 and the chamber 64 defined by the second vertical tube 70 (see FIG. 3). The horizontal tube 56 is in fluid communication with the second vertical tube 70. The second cross-sectional area 62 is greater than the sum of the first cross-sectional area 60 and the third cross-sectional area 72 such that the volume of the catch basin 12 is greater along the bottom surface 38 relative to volume of the catch basin along the upper end 36. It should be noted that the although FIG. 1 depicts the second vertical tube 70, the catch basin 12 may or may not include the second vertical tube 70.

The sump system 10 may further include adjustable clamps 74 that are secured to the catch basin 12 along the bottom surface 38 of the catch basin 12. Each of the adjustable clamps 74 may comprise a pair of rails or bars that are configured to engage opposing sides of one of the pumps 14 to secure the position of the respective pump 14 within the catch basin 12. The adjustable clamps 74 may also reduce any noise or vibration produced by the one or more pumps 14. Slots 76 may be machined out of the bottom surface 38 of the catch basin 12. The adjustable clamps 74 may be disposed within the slots 76 and may be slidable within the slots 76 such that the adjustable clamps 74 may engage and secure the positions of differently sized pumps within the catch basin 12. Once the clamps 74 have been positioned to engage the pump 14, the clamps 74 may be secured in place within the slots 76 via bolts 78 or any other type of fasteners (e.g., rivets).

Perforated caps 80 may be secured to the first end 50 of the horizontal tube 56 and to the second end 52 of the horizontal tube 56. The perforated caps 80 define orifices 82 that allow water to flow directly into and out of the horizontal chamber 24. This may be advantageous if the catch basin 12 is utilized outdoors and is disposed in an area that is configured to dissipate water over a large area. For example, the catch basin may be part of a French drain where all or a portion of the catch basin (e.g., the horizontal tube 56) is disposed within a ditch or hole in the ground that is filled with small stones. The stones of the French drain are then covered with soil. The space between the stones allows for storage of water below ground level when the adjacent soil becomes saturated with water, while the stones provide support for the ground immediately above the French drain. The perforated caps 80 allow water to flow out of the horizontal chamber 24 and into the space surrounding the stones to dissipate the excess water when the ground adjacent to the stones is not saturated. On the other hand, when the ground adjacent to the stones becomes saturated the catch basin 12 provides additional storage if the aggregate space surrounding the small stones also becomes filled with water.

Referring to FIGS. 4-7, alterative embodiments of the catch basin 12 are illustrated. Unless otherwise stated herein, the catch basin described in FIGS. 4-7 will have the same characteristics and will function the same as the catch basin 12 described in FIGS. 1-3. Each of the tubes of the catch basins described in FIGS. 4-7 is similar to the tubes (i.e., tubes 54, 56, and 70) of catch basin 12 described in FIGS. 1-3 in that each tube defines a respective chamber that extends in the same direction as the tube (e.g., vertically or horizontally). Each of the tubes described in FIGS. 4-7 is different from the tubes described in FIGS. 1-3 in that each of the tubes and respective chambers in FIGS. 4-7 have circular cross-sectional areas while each of the tubes and respective chambers in FIGS. 1-3 have square-shaped or rectangular cross-sectional areas.

Figure 4:
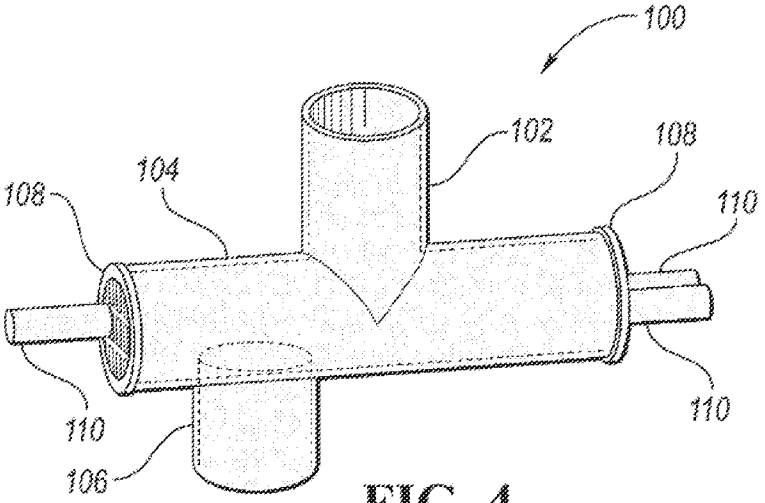
FIG. 4 is an alternative embodiment of the catch basin.

FIG. 4 depicts a catch basin 100 that includes a first vertical tube 102, a second vertical tube 106, and a first horizontal tube 104. The first vertical tube 102 may extend upward from and may be perpendicular to the first horizontal tube 104. The second vertical tube 106 may extend downward from and may be perpendicular to the first horizontal tube 104. The catch basin 100 may also include perforated caps 108 that are disposed on opposing ends of the first horizontal tube 104. The perforated caps 108 may have the same functionality and may have the same physical characteristics as the perforated caps 80 described above. One or more connection tubes or pipes 110 may extend through one or more of the perforated caps 108 and into the first horizontal tube 104. The connection tubes or pipes 110 may be connected to drains or a drainage system via additional pipes (not shown) that are configured to direct runoff water into the catch basin 100. The drainage system may be a drainage system of a building (e.g., FIG. 1) or may be part of a drainage system for an outside area, such as a field that is being utilized for some purpose, such as a sporting event.

Figure 5:
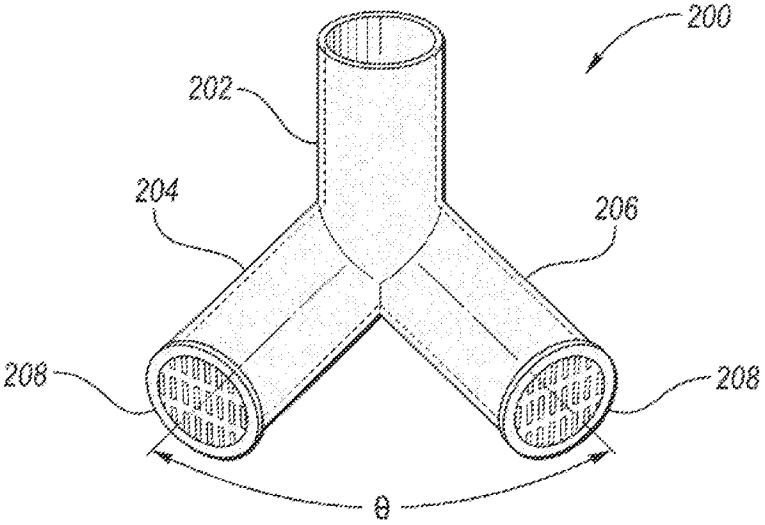
FIG. 5 is a second alternative embodiment of the catch basin.

FIG. 5 depicts a catch basin 200 that includes a first vertical tube 202, a first horizontal tube 204, and a second horizontal tube 206. The first horizontal tube 204 and the second horizontal tube 206 may each be perpendicular to the first vertical tube 202. The first horizontal tube 204 and the second horizontal tube 206 may extend horizontally outward at an angle θ relative to each other that ranges between 45° and 180° from a bottom end of the first vertical tube 202. The catch basin 200 may also include perforated caps 208 that are disposed on ends of the first horizontal tube 204 and second horizontal tube 206. The perforated caps 208 may have the same functionality and may have the same physical characteristics as the perforated caps 80 described above. One or more connection tubes or pipes (not shown) may extend through one or more of the perforated caps 208 and into the first horizontal tube 204 or into the second horizontal tube 206. The connection tubes or pipes may be connected to drains or a drainage system via additional pipes (not shown) that are configured to direct runoff water into the catch basin 200. The drainage system may be a drainage system of a building (e.g., FIG. 1) or may be part of a drainage system for an outside area, such as a field that is being utilized for some purpose, such as a sporting event.

Figure 6:
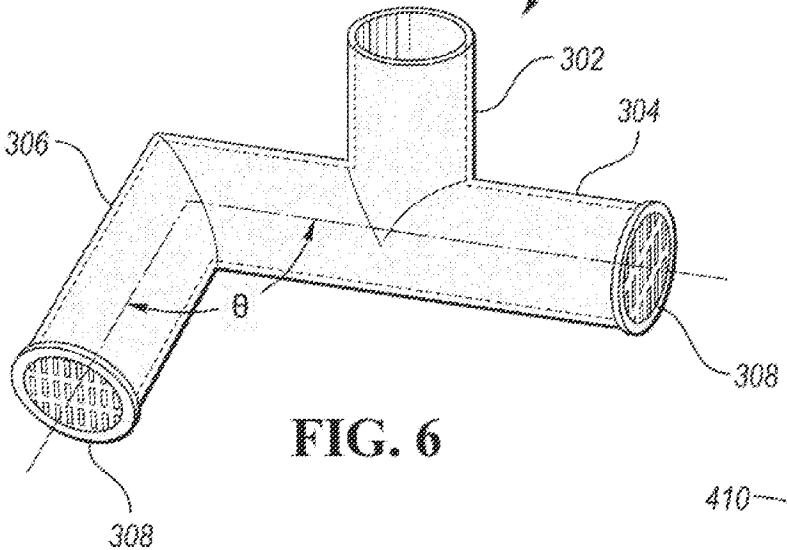
FIG. 6 is a third alternative embodiment of the catch basin.

FIG. 6 depicts a catch basin 300 that includes a first vertical tube 302, a first horizontal tube 304, and a second horizontal tube 306. The first horizontal tube 304 and the second horizontal tube 306 may each be perpendicular to the first vertical tube 302. The first vertical tube 302 intersects and is directly connected to the first horizontal tube 304 but not the second horizontal tube 306. The first horizontal tube 304 and the second horizontal tube 306 may extend horizontally outward at an angle θ relative to each other that ranges between 45° and 180°. The catch basin 300 may also include perforated caps 308 that are disposed on ends of the first horizontal tube 304 and second horizontal tube 306. The perforated caps 308 may have the same functionality and may have the same physical characteristics as the perforated caps 80 described above. One or more connection tubes or pipes (not shown) may extend through one or more of the perforated caps 308 and into the first horizontal tube 304 or second horizontal tube 306. The connection tubes or pipes may be connected to drains or a drainage system via additional pipes (not shown) that are configured to direct runoff water into the catch basin 300. The drainage system may be a drainage system of a building (e.g., FIG. 1) or may be part of a drainage system for an outside area, such as a field that is being utilized for some purpose, such as a sporting event.

Figure 7:
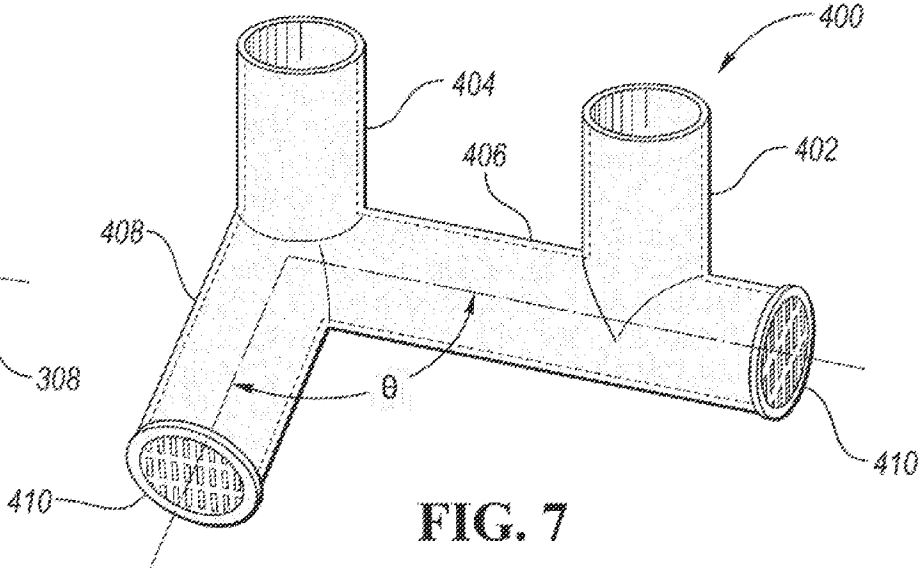
FIG. 7 is a fourth alternative embodiment of the catch basin.

FIG. 7 depicts a catch basin 400 that includes a first vertical tube 402, a second vertical tube 404, a first horizontal tube 406, and a second horizontal tube 408. The first horizontal tube 406 and the second horizontal tube 408 may each be perpendicular to the first vertical tube 402 and second vertical tube 404. The first vertical tube 402 intersects and is directly connected to the first horizontal tube 406 but not the second horizontal tube 408. The second vertical tube 404 intersects and is connected to both the first horizontal tube 406 and the second horizontal tube 408 along the intersection between the first horizontal tube 406 and the second horizontal tube 408. The first horizontal tube 406 and the second horizontal tube 408 may extend horizontally outward at an angle θ relative to each other that ranges between 45° and 180°. The catch basin 400 may also include perforated caps 410 that are disposed on ends of the first horizontal tube 406 and second horizontal tube 408. The perforated caps 410 may have the same functionality and may have the same physical characteristics as the perforated caps 80 described above. One or more connection tubes or pipes (not shown) may extend through one or more of the perforated caps 410 and into the first horizontal tube 406 or second horizontal tube 408. The connection tubes or pipes may be connected to drains or a drainage system via additional pipes (not shown) that are configured to direct runoff water into the catch basin 400. The drainage system may be a drainage system of a building (e.g., FIG. 1) or may be part of a drainage system for an outside area, such as a field that is being utilized for some purpose, such as a sporting event.

Although the vertical tubes, horizontal tubes, and the respective vertical and horizontal chambers are depicted herein as having square, rectangular, or circular cross-sectional areas, it should be understood that the vertical tubes, horizontal tubes, and the respective vertical and horizontal chambers may have a shape that is any desirable shape.

It should also be understood that the designations of first, second, third, fourth, etc. for height dimensions, width dimensions, chambers, tubes, pumps, portions of surfaces, or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A sump system comprising:

a catch basin configured to receive runoff water, having an upper end and a bottom surface, and defining a vertical chamber extending downward in a vertical direction from the upper end to a first portion of the bottom surface, a horizontal chamber intersecting the first chamber to form an intersecting region, the horizontal chamber defined by an upper surface and a second portion of the bottom surface, extending outwardly in a horizontal direction from an outer periphery of the first chamber, and having a vertical dimension that extends upward from the bottom surface to the upper surface, wherein the upper surface is positioned below the upper end, and a second vertical chamber extending downward from the upper end to a third portion of the bottom surface, wherein the horizontal chamber intersects the second vertical chamber to form a second intersecting region;

a sump pump disposed within the catch basin;

a second sump pump disposed within the second intersecting region; and first and second perforated caps secured to the catch basin and disposed at first and second opposing ends of the horizontal chamber, respectively.

2. The sump system of claim 1 further comprising first and second inlet pipes extending through the first and second perforated caps, respectively, and into the horizontal chamber.

3. The sump system of claim 1, wherein the sump pump is disposed within the intersecting region.

4. The sump system of claim 1 further comprising adjustable clamps secured to the catch basin along the bottom surface, wherein the adjustable clamps are configured to engage and secure the position of the sump pump within the catch basin.

5. A sump system comprising:

a catch basin configured to receive runoff water, the catch basin having a bottom surface and an upper end, and defining a first chamber having a first height dimension that extends vertically downward from the upper end to a first portion of the bottom surface and having a first width dimension, a second chamber intersecting the first chamber to form an intersecting region, having a second height dimension that extends vertically upward from a second portion of the bottom surface to an upper surface, and having a second width dimension that extends horizontally outward from an outer periphery of the first chamber to a horizontal end of the second chamber, wherein the second height dimension is less than the first height dimension, and a third chamber, extending vertically upward from a third portion of the bottom surface to the upper end, and intersecting the second chamber to form a second intersecting region;

a sump pump disposed within the intersecting region;

a second sump pump disposed within the second intersecting region; and a perforated cap secured to the catch basin and disposed at the horizontal end of the second chamber.

6. The sump system of claim 5 further comprising an inlet pipe extending through the perforated cap and into the second chamber.

7. The sump system of claim 5, wherein the catch basin defines a third chamber intersecting the second chamber, the third chamber extending vertically downward from a third portion of the bottom surface.

8. The sump system of claim 5 further comprising adjustable clamps secured to the catch basin along the bottom surface, wherein the adjustable clamps are configured to engage and secure the position of the sump pump within the catch basin.

9. A catch basin that is configured to receive runoff water comprising:

a first tube extending downward from an upper end to a lower end of the catch basin, the first tube having a first cross-sectional area that is defined along a first plane that extends horizontally though the first tube;

a second tube extending horizontally outward from the lower end at a position that is below the upper end, wherein the second tube is in fluid communication with the first tube and has a second cross-sectional area that is defined along a second plane that extends horizontally though the second tube, and wherein the second cross-sectional area is greater than the first cross-sectional area;

adjustable clamps secured to the catch basin along a bottom surface of the second tube, wherein the adjustable clamps are configured to engage and secure the position of a sump pump within the catch basin; and a perforated cap secured to a horizontal end of the second tube.

10. The catch basin of claim 9 further comprising a third tube extending vertically downward from the second tube, wherein the third tube is in fluid communication with the first and second tubes.

11. The catch basin of claim 9 further comprising a second perforated cap secured to a second horizontal end of the second tube.

12. The catch basin of claim 9 further comprising further comprising an inlet pipe extending through the perforated cap and into the second tube.

* * * * *